US005350352A

United States Patent [19]

Buchholtz et al.

[11] Patent Number: 5,350,352

[45] Date of Patent: Sep. 27, 1994

[54] ACOUSTIC PRESSURE PULSE GENERATOR

[75] Inventors: Gerhard Buchholtz; Matthias Mahler, both of Erlangen, Fed. Rep. of Germany

[73] Assignee: Siemens Aktiengesellschaft, Munich, Fed. Rep. of Germany

[21] Appl. No.: 830,912

[22] Filed: Feb. 4, 1992

[30] Foreign Application Priority Data

Feb. 21, 1991 [DE] Fed. Rep. of Germany ..... 4105476

[51] Int. Cl.[5] ..... A61B 17/22

[52] U.S. Cl. ..... 601/4; 367/175

[58] Field of Search ..... 128/24 EL, 660.03; 367/175; 601/4, 3

[56] References Cited

U.S. PATENT DOCUMENTS 4,674,505 6/1987 Pauli et al. .
4,697,588 10/1987 Reichenberger .
4,901,709 2/1990 Rattner .
4,928,672 5/1990 Grasser et al. .
4,977,888 12/1990 Rietter et al. .
5,165,388 11/1992 Hartinger ..... 128/24 EL
5,207,215 5/1993 Rattner et al. ..... 128/24 EL

FOREIGN PATENT DOCUMENTS 0242565 10/1987 European Pat. Off. .
3312014 10/1984 Fed. Rep. of Germany .
3443295 6/1986 Fed. Rep. of Germany .

*Primary Examiner*—Ruth S. Smith
*Attorney, Agent, or Firm*—Hill, Steadman & Simpson

[57] ABSTRACT

A pressure pulse generator has a pressure pulse source with a membrane that is rapidly displaceable from an initial position for generating acoustic pressure pulses in an acoustic propagation medium. For returning the membrane to its initial position, the acoustic propagation medium adjoining the membrane is maintained at an elevated static pressure in comparison to the ambient pressure. Additionally, a cooling arrangement for the pressure pulse source is provided for eliminating the dissipated heat arising during operation of the pressure pulse source. The cooling system contains a coolant that flows in a closed circulation path through a channel integrated into the pressure pulse source and through a cooling unit.

10 Claims, 2 Drawing Sheets

ACOUSTIC PRESSURE PULSE GENERATOR

BACKGROUND OF THE INVENTION

1. Field of the Invention

The invention is directed to a pressure pulse generator of the type having a pressure pulse source for generating acoustic pressure pulses in an acoustic propagation medium by rapid displacement of a membrane from an initial position by an electromagnetic, pneumatic or mechanical drive.

2. Description of the Prior Art

Pressure pulse generators of the type described above can be employed for a large variety of purposes, for example in medicine to non-invasively disintegrate calculi situated in the body of a patient, or to non-invasively treat pathological tissue changes. Positive (greater than atmospheric) pressure pulses are employed in the former instance and preferably negative (less than atmospheric) pressure pulses are employed in the latter instance. Further, such pressure pulse generators can be employed, for example, in materials testing to charge material specimens with pressure pulses. The pressure pulse generator is always acoustically coupled to the subject to be acoustically-irradiated in a suitable way, so that the pressure pulses generated in the acoustic propagation medium can be introduced into the subject. The pressure pulse generator and the subject to be acoustically-irradiated must be aligned relative to one another such that the region of the subject to be acoustically-irradiated is situated in the propagation path of the pressure pulses. When the pressure pulse generator provides focused pressure pulses as an output, it must also be assured that the region of the subject to be acoustically irradiated is situated in the focus region of the pressure pulses.

U.S. Pat. No. 4,674,505 discloses a pressure pulse generator of the type initially described. The generator described therein is an electromagnetic shock wave generator that generates positive pulses. In this type of generator, an electrical coil arrangement builds up a magnetic field extremely quickly when charged with a high-voltage pulse. This magnetic field induces a current in an electrically conductive membrane lying opposite the coil arrangement. This current is opposite the current flowing through the coil arrangement is being thus accompanied by a magnetic field opposite the magnetic field associated with the coil arrangement. As a consequence of the resulting repulsion forces, the membrane is suddenly moved away from the coil arrangement. A pressure pulse is thereby introduced into an acoustic propagation medium adjacent the membrane, which gradually intensifies into a shock wave along its propagation path.

A problem in pressure pulse generators of this type is that the membrane must be returned into its initial position after generating a pressure pulse. Only then it is guaranteed that the membrane assumes a defined initial position before generating the next pressure pulse; the membrane lying flush against the coil arrangement in this initial position in the case of electromagnetic pressure pulse generators. Return to a defined initial position is a prerequisite for successively generated shock waves coinciding with adequate precision with respect to their acoustic characteristics. In a pressure pulse generator disclosed in European Application 0 188 750, corresponding to U.S. Pat. No. 4,697,588, the return of the membrane to its initial position is accomplished by charging that side of the membrane facing away from the acoustic propagation medium with negative pressure. Although a reliable return of the membrane to its initial position is guaranteed in this way, a substantial structural outlay must be provided, as must a negative pressure source.

German Published Application 34 43 295 also discloses a pressure pulse generator of the type described above whose membrane is returned into its initial position by the acoustic propagation medium that resides at a static pressure. This technique has the disadvantage that the acoustic propagation medium adjoining the membrane cannot be conducted through a cooler in a circulation loop during operation in the way known from European Application 0 265 741, corresponding to U.S. Pat. No. 4,977,888, without additional outlay. Such cooling is necessary for eliminating the dissipated heat that arises during operation of the pressure pulse source to prevent premature failure of the pressure pulse source because of inadmissibly elevated operating temperatures, particularly due to failure of the membrane subject to high mechanical stresses.

SUMMARY OF THE INVENTION

An object of the present invention is to provide a pressure pulse generator of the type having a membrane which is rapidly displaced from an initial position wherein an adequate cooling of the pressure pulse source and production of pressure pulses essentially coinciding with one another with respect to their acoustic characteristics are guaranteed, both in an economic and structurally simple manner.

This object is inventively achieved in a pressure pulse generator having a pressure pulse source that, for generating acoustic pressure pulses in an acoustic propagation medium, has a membrane that can be rapidly displaced from an initial position and that terminates a pressure-tight space containing the acoustic propagation medium, means for maintaining the acoustic propagation medium contained in the space at a static pressure greater than the ambient pressure for returning the membrane to its initial position, and means for cooling the pressure pulse source arranged in the region of the pressure pulse source. The means for cooling contains a coolant that is separated from the acoustic propagation medium. The membrane is thus returned into its initial position after generating a pressure pulse in a simple manner by maintaining the acoustic propagation medium at an elevated static pressure. An effective elimination of the dissipated heat arising during operation of the pressure pulse source is simultaneously achieved in a simple manner with the means for cooling the pressure pulse source arranged in the region of the pressure pulse source, which is made possible because the coolant is separated from the acoustic propagation medium.

Another advantage which is achieved is that the acoustic propagation medium need not be employed as the coolant. On the contrary, different substances, which are respectively well-adapted to the specific demands, can be employed as the coolant and as the acoustic propagation medium. Dependent on the stiffness of the membrane, a relatively slight over pressure on the order of magnitude of less than 1 bar can suffice under certain conditions for returning the membrane into its initial position, so that it is comparatively easy to close the space accepting the acoustic propagation medium pressure-tight in such a way that the over pressure once set in the space during assembly of the pressure pulse generator is maintained for the overall useful life of the pressure pulse generator. The means for cooling the pressure pulse source is preferably a coolant flowing through a cooling unit in a closed circulation path. However, there is also the possibility of providing a so-called heat pipe or the like as means for cooling the pressure pulse source.

In an especially advantageous embodiment of the invention, the means for cooling the pressure pulse source includes conduit means integrated into the pressure pulse source traversed by the coolant. According to a preferred exemplary embodiment of the invention, an electrical coil arrangement that is fixed to a coil carrier is provided for the drive of the membrane, which contains electrically conductive material. The conduit means integrated into the pressure pulse source is in the form of a channel provided in the coil carrier through which the coolant flow. According to another embodiment that is particularly preferred because of its low structural outlay, an electrical coil arrangement wound of hollow wire is provided for driving the membrane containing electrically conductive material, and the conduit means integrated into the pressure pulse source is formed by the hollow wire through which the coolant flows.

Water is preferably provided as the acoustic propagation medium in the first space. However, it is also possible to provide a hydrogel as described in European Application 0 242 565. This is advantageous for assembly as well as during operation of the pressure pulse generator since the risk of air or gas bubbles being situated in or forming in the propagation medium is then extremely slight.

In a further embodiment of the invention, the space containing the acoustic propagation medium residing under elevated static pressure is situated between the membrane and a wall lying opposite thereto that separates the space from a volume of a second acoustic propagation medium. The pressure in the space situated between the membrane and the wall is thus independent of the pressure present on the other side of the wall. This is particularly significant when the volume containing the second acoustic propagation medium is terminated by a flexible coupling membrane, since the pressure fluctuations occurring when the pressure pulse generator is applied to a subject to be acoustically irradiated then have no influence on the restoring force acting on the membrane. In a preferred embodiment of the invention, the wall separating the first from the second space is fashioned as an acoustic lens. This is particularly advantageous when the pressure pulses emanating from the membrane require focusing and an acoustic lens is already required.

In another embodiment of the invention, the volume containing the second acoustic propagation medium is terminated by a flexible coupling membrane. Application of the pressure pulse generator to a subject to be acoustically irradiated is thereby easily facilitated.

DESCRIPTION OF THE PREFERRED EMBODIMENTS

Figure 1:
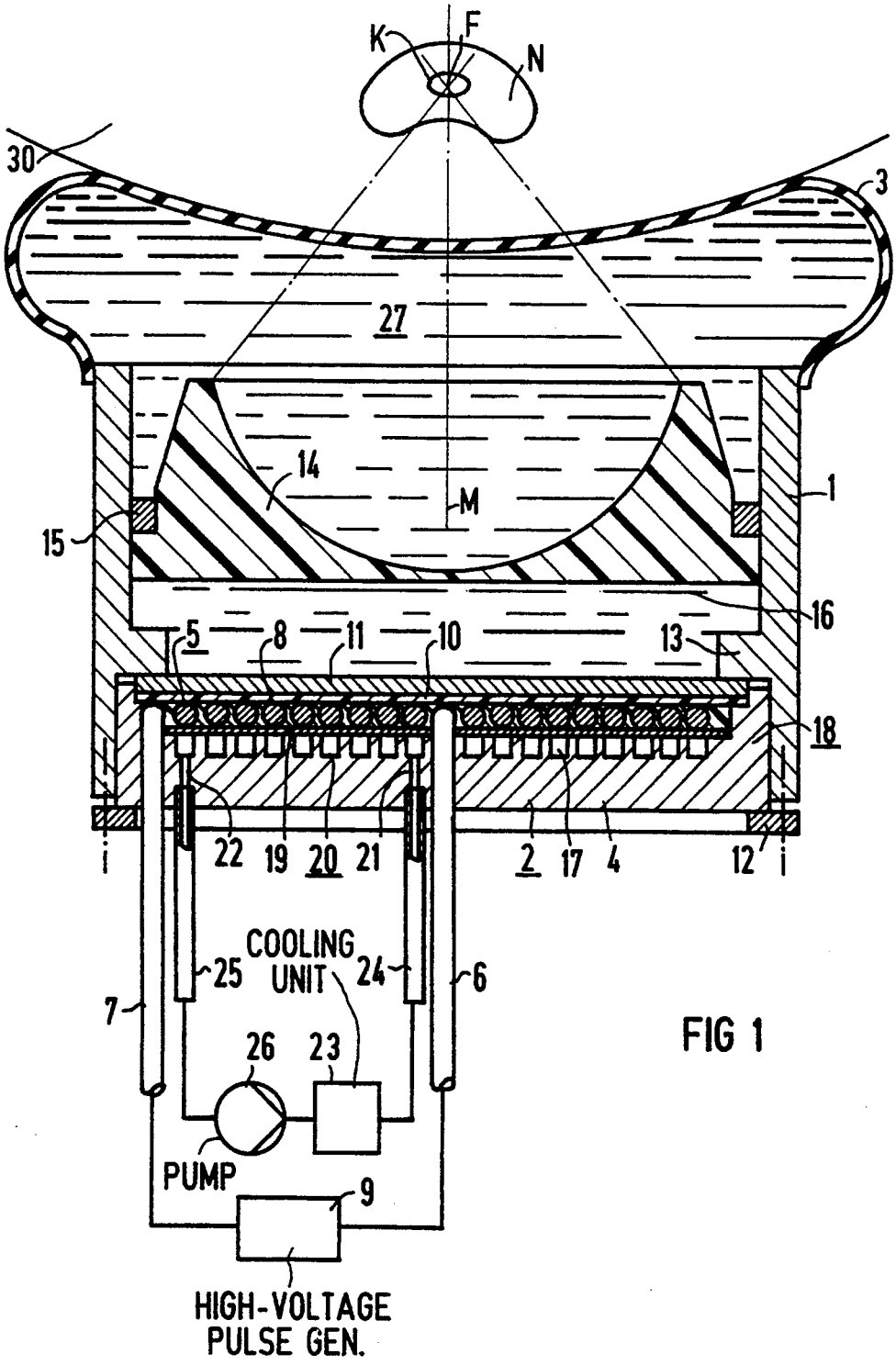
FIG. 1 shows a shock wave generator constructed in accordance with the principles of the present invention in longitudinal section with associated operating components being schematically shown.

An embodiment of the pressure pulse generator of the invention shown in FIG. 1 is in the form of a shock wave generator serving the purpose of disintegrating calculi in the body of a patient. The shock wave generator has a tubular housing 1 that is closed at one end by a pressure pulse (shock wave) source generally referenced 2, and is closed at its other end by a flexible coupling membrane 3. The shock wave source 2 includes a coil arrangement in the form of a flat or "pancake" coil 5 arranged on a planar seating surface of a coil carrier 4. The coil 5 has terminals 6 and 7 connecting the spiral turns 8 of the coil 5. The coil carrier 4 is formed of electrically insulating material, for example aluminum oxide ceramic. The space between the turns 8 of the coil 5 is filled with an electrically insulating casting resin. The terminals 6 and 7 are connected to an electrical high-voltage pulse generator 9.

A planar membrane 11 in the shape of a circular disc is disposed opposite that side of the coil 5 facing away from the coil carrier 4, with an insulating foil 10 disposed between the membrane 11 and the coil 5. The membrane 11 consists of an electrically conductive material, for example copper. The membrane 11, the insulating foil 10 and the coil 5 are combined with the coil carrier 4 to form a unit by means of a centering edge attached to the coil carrier 4. This unit is pressed against a shoulder 13 provided in the bore of the housing 1, by means of a ring 12 pressing against the coil carrier 4 and a plurality of screws—only the center lines of two screws being indicated with broken lines. The membrane 11 thereby presses liquid-tight and pressure-tight against the shoulder 13—possibly with the interposition of suitable sealants (not shown). A plano-convex, acoustic positive lens 14 consisting of polystyrol, for example, is inserted liquid-tight and pressure-tight into the bore of the housing 1 and lying opposite that side of the membrane 11 facing away from the coil 5, such that the planar side of the lens 14 faces toward the membrane 11. The positive lens 14 is axially fixed with a schematically indicated retainer ring 15 pressed into the bore of the housing 1 such that dislocations of the positive lens 14 in a direction away from the membrane 11 are impossible. A liquid, for example water, as the acoustic propagation medium 16 for the pressure pulses is situated in the liquid-tight and pressure-tight space situated between the positive lens 14 and the membrane 11, this space being limited by the housing 1 in addition to being limited by the membrane 11 and by the positive lens 14. This acoustic propagation medium 16 is at an elevated static pressure in comparison to the ambient pressure. This pressure is created when the pressure pulse generator is assembled in that the positive lens 14 is pressed against the water 16 situated in the first space, in the fashion of a piston and with a force corresponding to the pressure desired in the first space and is then fixed with the retainer ring 15. Though not shown, an aeration channel extending through the wall of the housing 1 into the first space and closed by an aeration valve can be provided for avoiding air bubbles.

The coil carrier 4 is two-piece and is composed of a base member 18 and a cover disc 19. The cover disc 19 forms the seat for the coil 5 and, possible with the use of suitable sealants (not shown), closes a channel 20 pressure-tight. The channel 20 has spiral turns and is formed in the base member 18. A coolant, for example a liquid like water, in the channel 20 flows through a cooling unit 23 in a closed circulation path. To this end, conduits 24 and 25 respectively connect an inlet 21 and an outlet 22 of the channel 22 to the cooling unit 23. A schematically indicated pump 26 is introduced into the conduit 24 for circulating the coolant. One of the turns of the channel 20 is referenced 17 in FIG. 1.

A liquid, for example water 27 as acoustic propagation medium for the pressure pulses, is contained in a volume situated between the positive lens 14 and the coupling member 3, this liquid being separated from the space containing the water 16 by the positive lens 14. The volume containing the water 27 is limited by the housing 1 in addition to being limited by the positive lens 14 and by the coupling membrane 3.

A shock wave is generated in a known way with the described shock wave generator by charging coil 5 with a high-voltage pulse from the high-voltage pulse generator 9. In response thereto, the coil 5 builds up a magnetic field extremely quickly, which induces a current in the membrane 11 that is opposite the current flowing through the coil 5. This current is accompanied by a magnetic field that is opposite the magnetic field of the coil 5. As a consequence of the resulting repulsion forces, the membrane 11 is suddenly moved away from the coil 5, thereby introducing a pressure pulse, which is initially planar, to the water adjoining the membrane 11 as the acoustic propagation medium and situated in the first space. This planar pressure pulse is focused onto a focus zone F with the positive lens 14 in the way indicated with broken lines in FIG. 1, this focus zone F lying on the center axis M of the shock wave generator. The focused pressure purse then propagate in the water contained as the acoustic propagation medium in the volume between the coupling membrane 3 and the positive lens 14. Using the coupling bellows 3 with the assistance of a known locating means, for example an x-ray locating means, the shock wave generator is pressed against the body of the patient 30 to be treated, in such a position that the calculus K to be disintegrated, for example a stone in a kidney N, is situated in the focus zone F. The calculus K can then be disintegrated into fragments by a series of pressure pulses, these fragments being so small that they can be eliminated in a natural way. Moreover, the pressure pulses emanating from the membrane 11 gradually intensify on their path through the water situated in the first and in the second space and through the body tissue of the patient 30 to form what are referred to as shock waves, which are pressure pulses having an extremely steep leading front.

As a consequence of the fact that the water 16 contained in the space situated between the membrane 11 and the positive lens 14 is at an elevated static pressure in comparison to the ambient pressure, it will be after the generation of a pressure pulse that the membrane 11 will be returned into its initial position wherein, with the interposition of the insulating foil 10, it presses flush against the surface of the coil 5. As a result, it is guaranteed that successively generated shock waves will each have the same acoustic characteristics. As a consequence of the fact that a coolant is conducted through the channel 20 of the coil carrier 4, it is also guaranteed that the dissipated heat arising during operation of the shock wave source 2 is eliminated, so that a premature outage of the shock wave source, particularly of the membrane 11 due to excessively high operating temperatures, is impossible. Since the positive lens 14 acts as a wall separating the space between the membrane 11 and positive lens 14 liquid-tight from the volume between positive lens 14 and coupling membrane 3, pressure changes in the volume between positive lens 14 and coupling membrane 3 that arise during the necessary pressing of the coupling membrane 3 against the patient 30 for applying the shock wave generator to the patient 30 have no influence on the pressure in the space between membrane 11 and positive lens 14. It is thus guaranteed that the pressure required for returning the membrane 11 always prevails in that space.

In the exemplary embodiments set forth, the same acoustic propagation medium as is situated in the volume between the positive lens 14 and the coupling membrane 3 is present in the space situated between the membrane 11 and the positive lens 14, namely water 16 or 27. This need not necessarily be the case. On the contrary, different acoustic propagation media can also be provided. For example, hydrogel 28 can be provided instead of the water 16 as propagation medium in the first-cited space, as indicated in the embodiment of FIG. 2.

Figure 2:
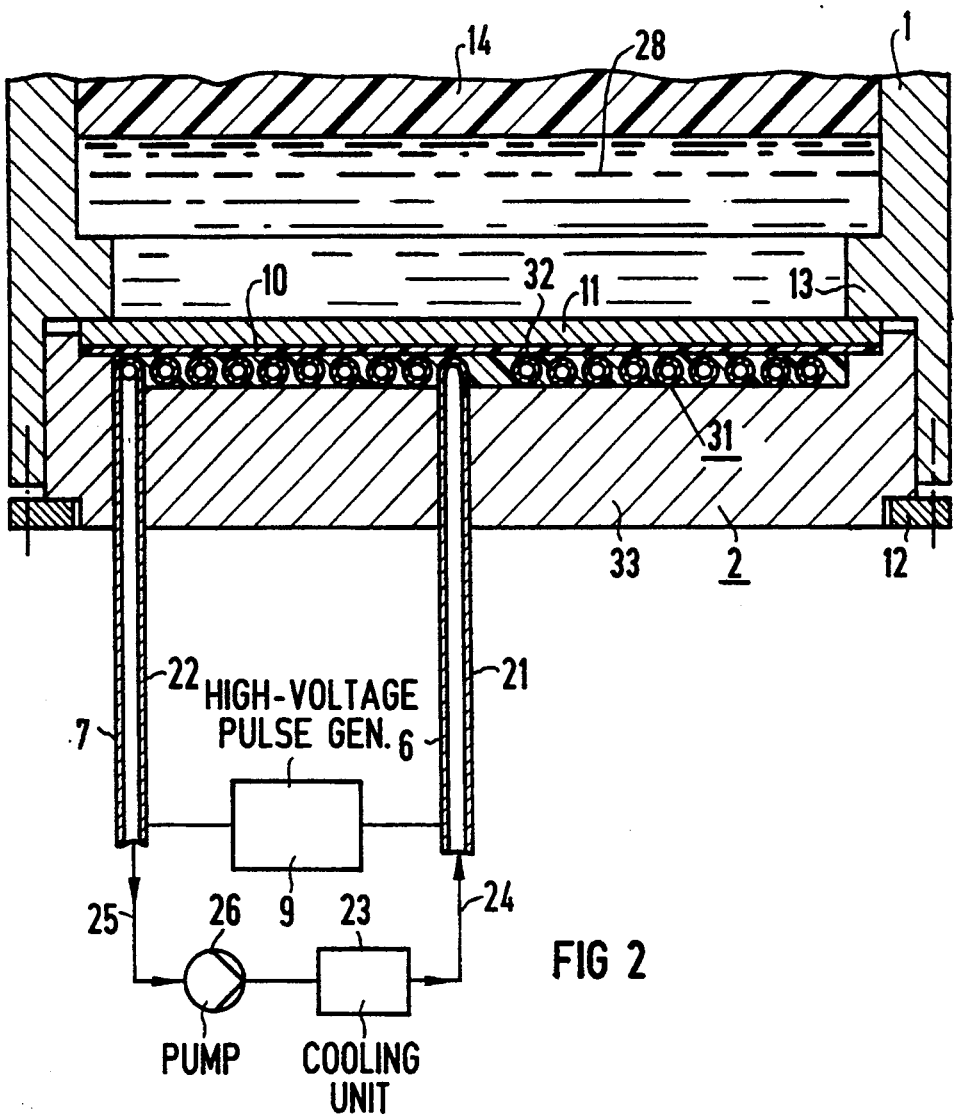
FIG. 2 shows an enlarged detail of a further embodiment of a shock wave generator constructed in accordance with the principles of the present invention in longitudinal section.

The shock wave generator of FIG. 2 differs from that set forth above in that the coil forming the coil arrangement and generally referenced 31 is formed by wound, hollow wire 32 wherein the coolant flows. The coil carrier 33 is one piece and has no channel for the coolant. The ends of the hollow wire 32 simultaneously respectively form the terminals 6 and 7 of the coil 32 and the inlet 21 and outlet 22 for the coolant.

If a pressure pulse generator does not require a positive lens (because it serves the purpose of generating unfocused pressure pulses or because its membrane is shaped, for example spherically curved, so that focused pressure pulses already emanate from it), a wall having plane-parallel end faces is provided instead of the positive lens 14 shown in FIGS. 1 and 2, this wall having end faces arranged such that no diffraction occurs when the shock waves pass through the wall. It is evident that such a wall or the positive lens 14 can be entirely omitted under certain circumstances.

The term liquid-tight and pressure-tight, as used herein mean that, during normal operation, water 16 does not undesirably emerge from the space situated between the membrane 11 and the positive lens 14, and an over pressure once set in the space also does not decrease.

Although the invention has been set forth herein with reference to the example of a shock wave generator serving medical purposes, it can also be employed in other pressure pulse generators.

Although modifications and changes may be suggested by those skilled in the art, it is the intention of the inventors to embody within the patent warranted hereon all changes and modifications as reasonably and properly come within the scope of their contribution to the art.

We claim as our invention:

1. A pressure pulse generator comprising:

a housing having a pressure-tight space terminated at one side by a membrane and containing an acoustic propagation medium, said membrane normally being disposed in an initial position in said housing;

means for rapidly displacing said membrane from said initial position causing said membrane to interact with said acoustic propagation medium to generate a pressure pulse therein;

means for maintaining said acoustic propagation medium in said space at a static pressure which is greater than the ambient pressure for returning said membrane to said initial position after displacement of said membrane; and means for cooling said membrane and said means for rapidly displacing said membrane containing a coolant which is separated from said acoustic propagation medium.

2. A pressure pulse generator as claimed in claim 1, wherein said means for cooling comprise a closed circulation path and a cooling unit and means for circulating said coolant through said closed circulation path and said cooling unit.

3. A pressure pulse generator as claimed in claim 1, wherein said membrane and said means for displacing said membrane form a pressure pulse source, and wherein said cooling means includes a conduit integrated into said pressure pulse source through which said coolant flows.

4. A pressure pulse generator as claimed in claim 3, wherein said membrane contains electrically conductive material and wherein said means for rapidly displacing said membrane includes an electrical coil disposed adjacent said membrane on a coil carrier, and wherein said conduit is a channel in said coil carrier through which said coolant flows.

5. A pressure pulse generator as claimed in claim 3, wherein said membrane contains electrically conductive material and wherein said means for rapidly displacing said membrane includes an electrical coil disposed adjacent said membrane, said electrical coil consisting of wound, hollow wire and wherein said conduit is the interior of said hollow wire through which said coolant flows.

6. A pressure pulse generator as claimed in claim 1, wherein acoustic propagation medium is water.

7. A pressure pulse generator as claimed in claim 1 wherein said acoustic propagation medium is a hydrogel.

8. A pressure pulse generator as claimed in claim 1, further comprising a wall disposed in said space containing said acoustic propagation medium dividing said space into first and second spaces, said first space being situated between said membrane and said wall, said acoustic propagation medium in said first space being maintained at said static pressure, and said second space containing a further acoustic propagation medium.

9. A pressure pulse generator as claimed in claim 8, wherein said second space is terminated at a side opposite said wall by a flexible coupling membrane.

10. A pressure pulse generator as claimed in claim 8, wherein said wall is an acoustic lens.

* * * * *